US006481576B1

(12) United States Patent
Watkins

(10) Patent No.: US 6,481,576 B1
(45) Date of Patent: Nov. 19, 2002

(54) PORTABLE/HANGING FEMININE SANITARY NAPKIN BAG

(76) Inventor: Lisa Watkins, 530 E. 169th St. Apt. 3H, Bronx, NY (US) 10456

( * ) Notice: Subject to any disclaimer, the term of this patent is extended or adjusted under 35 U.S.C. 154(b) by 0 days.

(21) Appl. No.: 08/722,345

(22) Filed: Sep. 27, 1996

(51) Int. Cl.[7] ..... A45C 15/00

(52) U.S. Cl. ..... 206/440; 206/38; 206/581; 190/109

(58) Field of Search ..... 206/37, 38, 229, 206/440, 570, 572, 581; 190/109, 111, 113

(56) References Cited

U.S. PATENT DOCUMENTS 1,648,565 A * 11/1927 Primley ..... 206/38
2,335,898 A * 12/1943 Arnold ..... 206/581
2,478,412 A * 8/1949 McMahan ..... 206/581
3,759,356 A * 9/1973 Bostick et al. ..... 190/113
4,236,615 A * 12/1980 Ginat ..... 190/113
4,883,207 A * 11/1989 McArthur ..... 190/113
4,960,208 A * 10/1990 Tempke ..... 206/581
5,046,620 A * 9/1991 Barabino ..... 206/38
5,159,999 A * 11/1992 Voigt ..... 190/111
5,494,157 A * 2/1996 Golenz et al. ..... 190/111
5,579,916 A * 12/1996 Manko ..... 132/312

* cited by examiner

*Primary Examiner*—David T. Fidei
(74) *Attorney, Agent, or Firm*—White & Case LLP

(57) ABSTRACT

A portable/hanging feminine sanitary napkin utility bag is provided for the storage and retrieval of feminine sanitary napkins consisting of a rectangular main housing with front, back, left, right and bottom panels, a top access opening closeable by a pivoting lid and an adjoining peripheral rim is horizontally attached to the uppermost edge of the back panel with a side access opening on the lowermost part of a side panel that is closeable by a pivotal flap allowing for the retrieval of one feminine sanitary napkin at a time and a pocket on the opposing side panel and back panel that provide for the storage of feminine supplies, contraceptives, panties or the like with a strap that straddles above the rectangular main housing and is affixed slightly remote from the uppermost edge of the side panels, allowing for portability and hanging.

17 Claims, 1 Drawing Sheet

PORTABLE/HANGING FEMININE SANITARY NAPKIN BAG

FIELD OF INVENTION

The present invention relates to a portable/hanging feminine sanitary napkin storage and retrieval bag and more particularly a portable/hanging feminine sanitary napkin bag configured and dimensioned to hold one full size consumer package of feminine sanitary napkins or the contents thereof in varying denominations, with a pocket(s) for storing feminine hygiene products, contraceptives, spare panties and the like, a side access opening closeable by a flap and a strap affixed to it's side panels forming a loop with length for portability or hanging.

The present invention is categorically unique in that it offers the first home/travel primary storage devise for feminine sanitary napkins. A devise to be constructed of fabrics, skins, textiles and the like that will be attractively decorated to blend into any decor.

BACKGROUND

For decades females of all ages have had to contend with the dilemma of where and how to store feminine sanitary napkins and how to keep them easily accessible at their time of need, whether at home or away.

In many instances feminine sanitary napkins have been hidden in dark, damp, and dusty corners of closets and cabinets in bed or bathrooms. Places where they are out in the open and/or exposed to the elements and away from arms reach.

In the presently many females end up stranded when in need of sanitary napkins, even in the privacy of in their own homes. They must secretly summon the assistance of female siblings, room mates or even their spouse. In instances where females are in multi-gender households, away from home, or young just beginning their menstruation, the task of seeking assistance can be very anxiety provoking and intimidating.

Placing feminine sanitary napkins at arms reach neatly and discretely in a feminine sanitary napkin storage and retrieval bag hertofore hung in bathrooms or bedrooms provides females with a totally portable/hanging easily accessible utility for feminine sanitary napkins whether at home or away.

This invention which can be constructed very economically with todays myriad of fabrics, skins, textiles and the like is extremely practical and equally unique.

PRIOR ART

Prior art has been for bags devised primarily for storage of small personal items like wallets, mirrors, and cosmetics. Others have been devised to store single or small hand held quantities of sanitary napkins, tampon and the like in a devise devoid of straps or handles that is disposed then again into a larger handbag or similar devise.

An example U.S. Pat. No. 4,739,809 to Adams discloses a handbag, with a plurality of article holding compartments for the dispensing of sheet materials. U.S. Pat. No. 5,123,467 to Steinberg discloses a utility bag means for storage and transport of baby paraphernalia which also generates sound. And U.S. Pat. No. 5,046,620 to Barabino disclosing a Portemonnaie assembly adapted to be disposed within a larger handbag, while storing a miniature tampon and a feminine napkin.

Large containers of the like of U.S. Pat. No. 4,848,588 to Rasmussen discloses a compact compartmental storage container for a multitude of feminine supplies and one devised for stationary usage. The later is not designated as a primary storage utility and is unable to store a full consumer size package of feminine sanitary napkins or the contents thereof in varying denominations as the present invention is. The present invention would not require further storage in yet another member and may be discretely hung or transported to/within any environment.

The present invention differs from these aforementioned inventions in that it is not a handbag or to be used as or with such. This inventions intended use is to portably store the contents of one full consumer size package of feminine sanitary napkins or it's contents in any deviation or variation thereof, conveniently and discretely. The present invention may be used as a primary storage utility and/or for varying denominations of feminine sanitary napkins at home and in travel.

In and of itself this invention can be used at home without any modification, attachments and/or host/companion apparatus and carried within/outside the home without any modification, attachments and/or host/companion devise.

What makes the present invention unique is that it can be hung or transported conspicuously while inconspicuously storing feminine sanitary napkins in bag constructed of fabrics, skins, textiles or the like that is attractively decorated and can blend in with any decor.

SUMMARY OF INVENTION

A portable/hanging feminine sanitary napkin storage and retrieval bag is provided formed by a rectangular main housing consisting of a front, back, left, right and bottom panel. The rectangular main housing is provided to store one full consumer size package of feminine sanitary napkins or the contents in any varying denomination.

A pocket is affixed to the lower perimeters of either the left or right side panel with a side access opening on the opposing side closeable by a pivotal flap. The flap extends horizontally overlapping the side access opening and secures on the front or back panel when in a closed position. The flap's fastener is affixed to the front panel in a front opening access bag and on the back in a back access opening bag.

The bag may have one or more pockets affixed to the back panel to store feminine hygiene products, tampon, contraceptives, panties or the like.

Affixed to the upper most part of the back panel is a lid with an adjoining perimeter rim. The rim extends down around the upper perimeters of the main housing over the top access opening and is closeable by a velcro fastener, notion or the like. The union of the lid and rim create an upwardly extending recessed interior space where elastic bands are attached to the front perimeter edge of the underside of the lid and extending laterally to the back perimeter edge and are thereby attached between the lid member and the rim providing for the storage of a reusuable/disposable douche bottle, elongated feminine hygiene product or the like.

A strap/handle is provided attached slightly recessed from the uppermost part of each opposing side panel staddling above the top access opening that is configured and dimensioned with significant length for easy portability and hanging. A smaller strap/handle is provided affixed to the top center of the back panel configured and dimension solely for hanging.

Ideally, the portable/hanging feminine sanitary napkin storage and retrieval bag will be contoured to a near corresponding size and dimension of one full consumer size package of feminine sanitary napkins and/or deviations and variations thereof. The bag will be constructed of fabric, skins, textiles and the like with weights and textures appropriate for both portability/hanging and each will be decorated attractively.

PREFERRED EMBODIMENT

Figure 1:
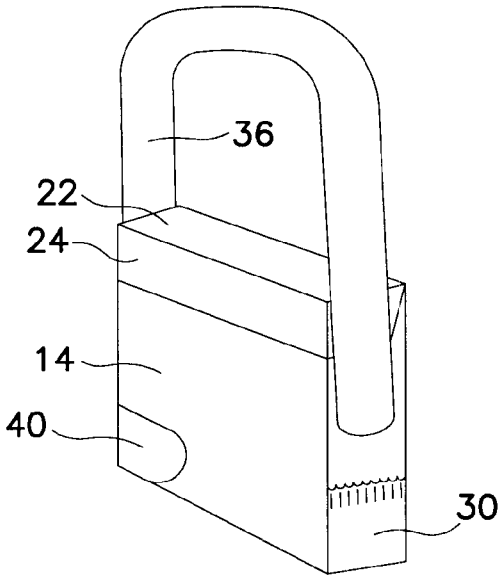
FIG. 1 is a perspective view of the present invention showing a front opening, left side access opening bag in a closed position.
Figure 2:
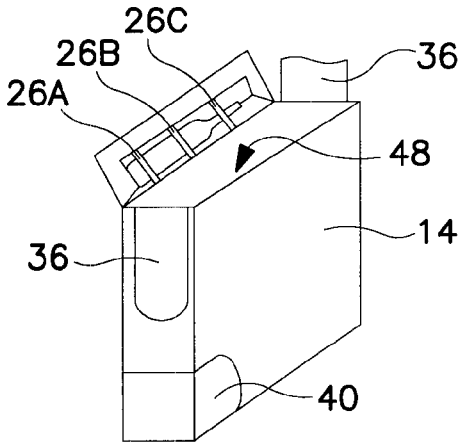
FIG. 2 is perspective view of the present invention showing a front opening, left side access opening bag with the lid in a open position exposing equally proportioned elastic strips storing an elongated feminine hygiene product.
Figure 3:
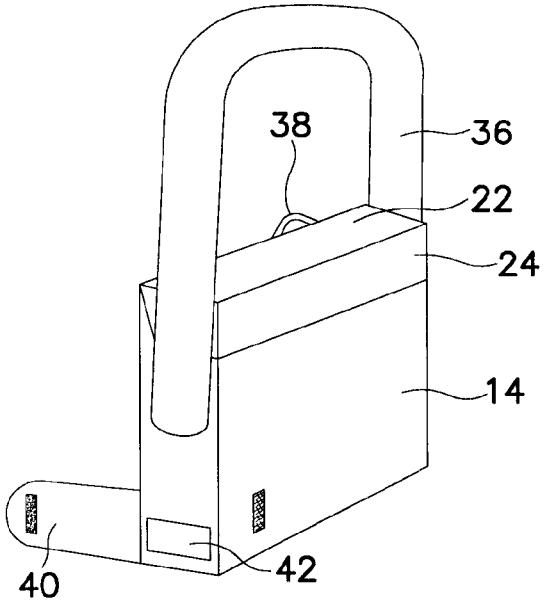
FIG. 3 is a perspective view of the present invention showing a front opening bag with the lid and adjoining rim in a closed position and the side access opening revealed by the open flap.
Figure 4:
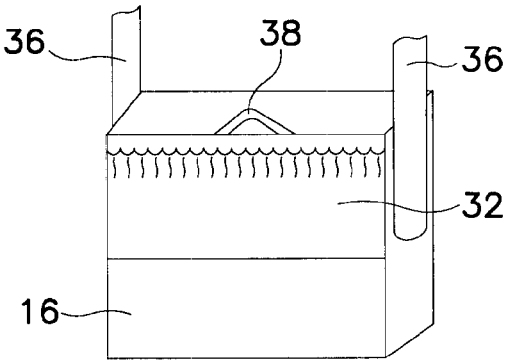
FIG. 4 is a perspective view of the present invention showing the back of a front opening bag with a pocket covering the uppermost part of the back panel.

With reference to the drawings and particularly to FIG. 1, thereof, the preferred embodiment of the portable/hanging feminine sanitary napkin storage and retrieval bag having the principles and concepts of the present invention generally designated 10 includes a rectangular main housing 12 formed by a front panel 14, back panel 16 with corresponding left side panel 18 and right side panel 20 affixed at it's lateral edges and bottom panel 50 created by folds on the lower most part of the front and back panel 14, and 16. The rectangular main housing 12 constructed preferably of fabrics, skins, textiles and the like with weight substantial for both portability and hanging having an inner lining 34 which fully underlies the panels of the rectangular main housing 12.

A top access opening 48 is provided for the disposal of one full consumer size package of feminine sanitary napkins or the contents thereof in any varying denomination. Affixed horizontally to the uppermost edge of said back panel 16 is a lid 22 configured and dimensioned to cover the aforementioned top access opening 48 formed with an adjoining rim 24 attached to peripheral edge of said lid 22. Said rim 24 extends downward overlapping the upper most part of rectangular main housing 12 so as when in a closed orientation access and view of contents is denied and when in an open orientation allows for the disposal or view of the contents therein.

On the underside of said lid 22 three elastic strips 26*a*, 26*b*, and 26*c* are placed proportionally and secured at front peripheral edge of said lid 22 and extend laterally to opposing peripheral edge and affixed between the union of said lid 22 and said rim 24 providing a storage means for a reusable/disposable douche bottle, elongated feminine hygiene product or the like.

In the preferred embodiment left side panel 18 and right side panel 20 provide side access opening 42 and pocket 30 respectively. Although their placement always opposing can be on either of the corresponding side panels 18 or 20. Side access opening 42 dimensioned in a rectangular configuration positioned longitudinally on lowermost part of either left panel 18 in left sided access opening bag or right side panel 20 in right sided access opening bag provide means for the retrieval of one feminine sanitary napkin at a time. Side access opening 42 is closeable by a flap 40 secured laterally at the junction of said side panel 18 or 20 and back panel 14 in a front closure orientation bag or front panel 14 in a back closure orientation bag. The junction constructed by stitching, hinged device or the like creating a pivotal connection whereby said flap 40 configured and dimensioned to conceal said side access opening 42 when in a closed orientation or when in an open orientation reveals and allows user access for retrieval of one feminine sanitary napkin at a time extends laterally to wraps around immediate edge of lowermost quadrant back panel 14 in back closure orientation bag or front panel 12 in front closure orientation bag to a fastener. Said fastener means affixed to inner lining 52 of said flap 40 and coupled with corresponding fastener means affixed to complimenting front panel 12 or back panel 14. Fastener means to be a velcro fastener, notion or the like. A pocket 30 affixed to the lower perimeter of with left panel 18 or right panel 20 provides for storage of small feminine hygiene products. contraceptives and the like. A larger pocket 32 or a sequence thereof are provided preferably on the uppermost part of back panel 14 configured and dimensioned for the storage of spare and/or disposable panties, tampons, and/or other feminine hygiene products or the like.

A strap/handle 36 affixed slightly remote from the uppermost edge of said left side panel 18 and said right panel 20 straddles above said top access opening 48 forming a loop with length significant for portability and hanging. A smaller strap/handle 38 configured in a loop like orientation secured to the uppermost top center back panel 14 is affixed thereon providing a means solely for hanging.

I claim:

1. A portable storage container sized and configured for receiving and dispensing sanitary napkins, comprising:

a main housing for storage of a plurality of sanitary napkins, wherein the main housing comprises a front panel, a back panel, a left side panel, a right side panel and a bottom panel which together form an internal compartment and a top access opening to the compartment;

a side access opening being defined by one of the side panels, wherein the side access opening is sized and configured to allow passage of at least one sanitary napkin at a time;

a flap having a first end secured to the main housing and a second end releasably securable to the main housing, wherein the flap is positioned to cover the side access opening when the second end of the flap is secured to the main housing; and a lid sized and configured to covet the top access opening.

2. The portable storage container according to claim 1, wherein the panels are joined at their edges to form the internal compartment.

3. The portable storage container according to claim 1, wherein the side access opening is completely defined by the side access panel.

4. The portable storage container according to claim 1, wherein the side access opening is adjacent to the bottom panel.

5. The portable storage container according to claim 1, wherein the side access opening is sized and configured to allow passage of only one sanitary napkin at a time through the opening.

6. The portable storage container according to claim 1, wherein the lid is pivotally attached to the top portion of at least one of the front, back or side panels so that the lid may be opened and closed while remaining attached to the main housing.

7. The portable storage container according to claim 1, further comprising one or more elastic bands secured to the inner side of the lid.

8. The portable storage container according to claim 1, further comprising a storage pocket attached to and disposed on the outer surface of the side panel opposite the side panel which defines the side access opening.

9. The portable storage container according to claim 1, further comprising a strap for carrying the container, wherein the strap has a first end and a second end, each of the ends being attached to the container.

10. The portable storage container according to claim 9, wherein the first end of the strap is attached to a side panel of the main housing and the second strap is attached to the opposing side panel of the main housing, and wherein the level of attachment of the first and second ends is above the level of the side access opening.

11. The portable storage container according to claim 1, further comprising a handle.

12. The portable storage container according to claim 1, wherein the container is composed of a material selected from the group consisting of fabric, textile or animal skin.

13. A portable storage container sized and configured for receiving and dispensing sanitary napkins having a short axis and two longer axes, comprising;

a main housing for storage of a plurality of sanitary napkins, wherein the main housing comprises a front panel, a back panel, a left side panel, a right side panel and a bottom panel which together form a internal compartment and a top access opening to the compartment;

a side access opening being defined by one of the side panels, wherein the side access opening is sized and configured to allow passage of only one sanitary napkin at a time when the short axis of the sanitary napkin is oriented substantially perpendicular to the plane defined by the bottom panel;

a flap having a first end secured to the main housing and a second end releasably securable to the main housing, wherein the flap is positioned to cover the side access opening when the second end of the flap is secured to the main housing; and a lid sized and configured to cover the top access opening.

14. The portable storage container according to claim 13, wherein the main housing is sized and configured to hold and substantially conform to one full consumer-sized package of sanitary napkins.

15. The portable storage container according to claim 13, further comprising a carrying means for carrying the container.

16. The portable storage container according to claim 13, or 15, further comprising a hanging means for hanging the container in an upright orientation.

17. A portable storage container, comprising;

a rectangular main housing for storage of a plurality of items, the rectangular main housing comprising a front panel, a back panel, a left side panel, a right side panel and a bottom panel, wherein the panels are joined at their edges to form an internal compartment and a top access opening to the compartment;

a side access opening being defined by one of the side panels, wherein the side access opening is sized and configured to allow passage of at least one of the items at a time;

a flap having a first end secured to the main housing and a second end releasably securable to the main housing, wherein the flap is positioned to cover the side access opening when the second end of the flap is secured to the main housing; and a lid sized and configured to cover the top access opening.

* * * * *